US006259010B1

(12) United States Patent
Nagahara

(10) Patent No.: US 6,259,010 B1
(45) Date of Patent: Jul. 10, 2001

(54) PICCOLO

(76) Inventor: Kanichi Nagahara, 32 Wild Rose Dr., Andover, MA (US) 01810

( * ) Notice: Subject to any disclaimer, the term of this patent is extended or adjusted under 35 U.S.C. 154(b) by 0 days.

(21) Appl. No.: 09/574,802

(22) Filed: May 19, 2000

(51) Int. Cl.[7] ..... G10D 7/00

(52) U.S. Cl. ..... 84/380 R; 84/384; 84/382; 84/381; 84/383 R

(58) Field of Search ..... 84/380 R, 384, 84/382, 381, 383 R, 385 R

(56) References Cited

U.S. PATENT DOCUMENTS 1,166,971 * 1/1916 Conn ..... 84/380 R
3,568,561 * 3/1971 Gutsein ..... 84/383 R
4,058,046 * 11/1977 Fajardo ..... 84/384
4,353,281 * 10/1982 DeFord ..... 84/384
4,376,403 * 3/1983 Haedrich et al. ..... 84/384
5,014,585 * 5/1991 Wesley, Sr. ..... 84/384
5,524,520 * 6/1996 Brögger ..... 84/380 R
5,708,226 1/1998 Nagahara .

* cited by examiner

*Primary Examiner*—Shih-Yung Hsieh
(74) *Attorney, Agent, or Firm*—Lambert & Associates, P.L.L.C.; Gary E. Lambert; Donald J. MacDonald

(57) ABSTRACT

The present invention is directed towards an improved piccolo. The present invention incorporates several innovative design features that collectively enhance the sound and notes produced by the piccolo and also eases the playing transition between the piccolo and other instruments such as the flute. The present invention features a piccolo having an enlarged cylindrical-bore main body section and an enlarged conical bore headjoint section, enlarged toneholes for better ventilation and intonation, and an improved thumb key mechanism and other mechanisms for attaining notes of a heretofore unattainable tone quality, as well as a footjoint section which extends the lower range of the piccolo by three notes.

31 Claims, 10 Drawing Sheets

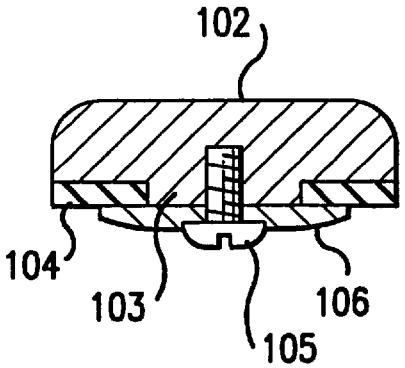
NEW
FIG.4B
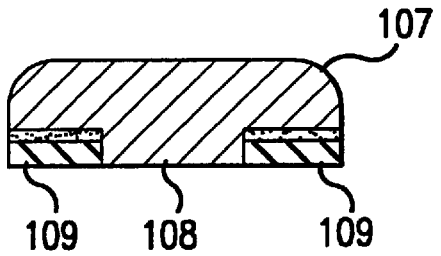
NEW
FIG.4C
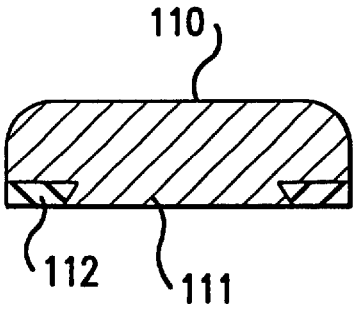
NEW
FIG.4D
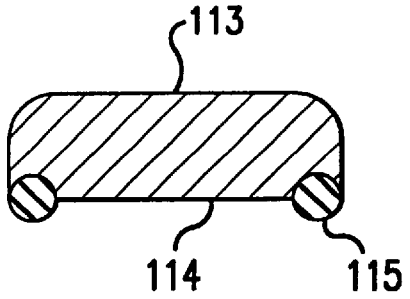
NEW
FIG.4E

PICCOLO

BACKGROUND OF THE INVENTION

This invention relates to musical instruments. More particularly, this invention relates to an improved piccolo and piccolo-type instruments having an improved head joint, bore, keys and levers capable of attaining better intonation and a fuller richer sound.

Though piccolos and flutes are commonly considered "cylindrical" bore instruments, they both have central bores that in fact vary slightly in diameter, i.e. the bores are tapered. It was realized by early flute makers that the optimum intonation of the upper octaves could be achieved by the introduction of a headjoint with a tapered bore, while the main body and footjoint of a flute remained strictly cylindrical. The internal diameters of the flute and piccolo have remained at 19.0 mm and 11.0 mm respectively, have not changed in over a hundred years, and are generally accepted to be unchangeable standards.

There are currently two types of piccolo bores available, both with a maximum diameter of 11.0 mm, which are those with a cylindrical body and conical headjoint, as with the flute, and those with a conical body and cylindrical headjoint. The latter is by far the most popular among professional musicians, the tapered head of the former being too small a diameter to produce a quality sound in the middle and low registers. While the conical bore piccolo's headjoint is large enough to produce the desired tone, the conical-bore piccolo suffers from poor tone hole ventilation (due to the small 11.0 mm diameter), which produces a "small" sound that is relatively inflexible with regard to tone color and dynamics as compared with the flute. In addition, the preferred taper for the main body limits its length, which prevents the extension of the piccolo's range from the current "low-D" down to "low-C" and "-B", as is seen on the larger flute. This limits the performance repertoire available to the piccolo player, as the player would not be able to play any note below the note "low-D" which may be written for the flute. Also, the extra body length afforded by these low notes on the flute assists in the acoustics of the extreme upper register. This extra length, and the accompanying advantages, is not, as mentioned above, available on the conical-bore piccolo today. Metal cylindrical-bore piccolos indeed have a headjoint long enough for the proper taper, but the taper starts from 11.0 mm, the result of which is a minimum diameter which is too small to produce the desired tone.

There exist, particularly in piccolos made of metal, previous cylindrical-bore designs which attempt to include a footjoint section, extending the lower range as described above. However, these designs have retained the maximum bore size of 11.0 mm, and as a consequence still produce a less than optimum tone. The reason for not exceeding the traditional 11.0 mm diameter bore is that the necessarily larger toneholes accompanying an enlarged bore would be covered in turn by larger keys which would crowd in upon each other.

The traditional tenon design of the wooden piccolo prevents the realization of a properly tapered headjoint. The tenon is that portion of the piccolo that joins the headjoint to the body. Since the two parts of the tenon must be cylindrical in order to fit properly, the "female" headjoint tenon takes up length which could otherwise be tapered to achieve the proper intonation. In other words, the traditional tenon design makes it impractical to have a tapered headjoint, the headjoint being too short. Another disadvantage to the traditional wooden piccolo tenon design is that most wooden piccolo tenons have a cork band on the "male" body section of the piccolo at the interfacing junction between the headjoint and the body sections of the piccolo. This cork band provides an airtight seal between the headjoint and the body receiving the headjoint. Cork, being a natural organic material tends to dry out over time. The drying cork band shrinks, cracks and thus ceases to provide an airtight seal thereby necessitating the regular replacement of the cork band. A previous metal-to-metal tenon design for the wooden piccolo exists; however, due to the difference between the outside and the inside diameters of the wooden piccolo, there is often a gap of nearly ¼" which becomes visible as the player tunes the instrument by partially pulling out the headjoint to increase the effective tube length. This is considered by many players to be aesthetically unappealing. Appearance is especially important in the field of handcrafted musical instruments, where the instruments are valued for the way they look as well as the sound they produce. In addition, the resulting connected joint creates a weak point at which severe damage to the instrument could occur if the instrument is dropped or struck.

The thumb mechanism of a traditional piccolo leaves much to be desired. On the traditional piccolo, the B-flat lever closes the B tone hole by activating the key directly covering the B tone hole via the traditional piccolo thumb mechanism, rotating on an axis parallel to the length of the instrument. Since the B-flat key is also on a parallel axis, the result is a lever mechanism which is uncomfortable, being against the natural tendency of the thumb motion. In addition, the space limitations of the traditional piccolo and the parallel axle require that the thumb key assembly and toneholes be placed low on the body radius, below the so-called "water line", where the condensation which occurs naturally when playing the piccolo collects and effectively blocks the toneholes.

A popular option for many flute players today is the C# trill mechanism. The C# mechanism, by its placement next to the thumb key, facilitates not only the note "C#", but many other notes as well, and is considered to be a major improvement on the traditional flute. The addition of a C# trill key on the piccolo has heretofore been impossible due to the conventional thumb key design of previous piccolos, which do not allow space for another tonehole between the C and trill toneholes.

Due to the short length of the piccolo tube, as well as the number of keys limited by the piccolo's small size, there are several notes in the extreme high range of the piccolo which, although theoretically exist, cannot be sounded. For example, in order to obtain the optimum tone for the note "high F#", it is desirable to close the B-flat tonehole independently of the neighboring B tonehole. However, on the traditional piccolo, this cannot be done due to the configuration of the keys. The mechanism required to separate the action of the two keys covering these toneholes and achieve this optimum high F# is not found on previous piccolo designs due to space limitations, and indeed is so complicated that it rarely appears even on flutes.

A common problem note for the piccolo player is "high G#". In order to obtain the best ventilation for this note, it is desirable to partially close the C tonehole. A previous mechanism to accomplish this exists, but since it relies on the traditional piccolo thumb key design, it suffers from the same problems inherent in that configuration. In addition, the G# cup is located too far away from the thumb key for efficient lever action.

SUMMARY OF THE INVENTION

What is needed is a piccolo that is capable of producing the full complement of notes and tones delivered by an expertly played flute so that the transition between playing a flute and a piccolo is eased. The present invention addresses all of the inherent design problems discussed above and in the course of doing so encompasses aspects of an improved piccolo design that eases the transition one experiences when switching between flute and piccolo. In this way, tones possible from a piccolo incorporating the innovative design features of the present invention will be fuller and richer than those possible before and easier to achieve.

A significant component of the present invention is an enlarged cylindrical bore in the main body section, specifically redesigned for piccolos. An enlarged cylindrical bore offers the player several acoustic advantages over the traditional design, such as better tone control, a wider range of sound volume (dynamics), improved intonation, and more flexibility to produce artistic nuances in musical performance. Another advantage of a cylindrical bore is that the length of the piccolo can be increased without the detrimental effects realized in the conical-bore or 11.0 mm designs. The practical application with regard to the present invention is the addition of a "footjoint" section, which adds three notes (C#, C and B) to the lower register of the piccolo. In addition to the obvious benefit of increased repertoire as described above, the top registers of the piccolo benefit acoustically from the increased length of tubing.

The present invention also incorporates an improved key design. Instrument makers and acoustic scientists generally recognize that an increase in bore diameter necessitates a larger tonehole size, to provide proper ventilation. It is, in fact, for this reason, that the internal diameter of the piccolo has not increased beyond 11.0 mm since its inception. The piccolo, being an instrument which produces very high frequencies, is therefore very sensitive with regard to ventilation. The small toneholes on a traditional piccolo do not properly vent the tube, and therefore produce an inferior tone. The small size of the toneholes is made necessary in part by the short overall length of the instrument, i.e. larger toneholes would be covered by larger keys which would crowd each other. The traditional key design consists of a formed key cup which holds a pad, which in turn seals a tonehole. This design yields a key which is larger than necessary, as a certain amount of the formed cup occupies the same plane of the pad around its circumference, yet does not directly seal the tonehole. The unique key/pad design of the present invention eliminates the overhang of the formed c(up, and allows for a larger tonehole covered by a larger key without the problems of overcrowding.

The present invention incorporates a unique tenon design for piccolos. It is well known among flute makers that a cylindrical-bore piccolo or flute requires a conical-bore headjoint to correct the pitch and intonation of the upper octaves, which become flat as the player "leans in" to the flute in order to sound the upper registers. Previous wooden tenon designs limited the maximum length of the headjoint, which as a result, was not long enough for a proper taper. Both sections of the male-female tenon must be cylindrical, in order to have a proper interface which must be airtight yet easily adjustable to control the overall pitch of the piccolo. As previous wooden piccolo tenon designs located the female section of the interface in the headjoint, this cylindrical section reduced the length available for a proper taper. The present invention incorporates a male headjoint section which is outside the effective length of the headjoint, which is now, in turn, long enough to accommodate a proper taper. The tenon design of the present invention also comprises a stepped interface between the headjoint and the body of the piccolo. The stepped interface of the present invention is precision crafted like the rest of the piccolo, and thus is capable of providing an airtight seal between the headjoint and the body receiving the headjoint without the need for gaskets or additional seals. Unlike previous designs using a cork band at the interface, the piccolo of the present invention does not require frequent repair and replacement of any parts. An additional benefit realized from the stepped interface is the ability to observe, through graduated markings disposed on the tenon of the headjoint, the amount of separation between the body and headjoint, by which the performer may adjust the overall pitch of the piccolo, and thereby play in tune with other musicians. The piccolo of the present invention also has radial orientation markings along the outside of the tenon. These markings enable the piccolo player to precisely align and orient the blowhole and obtain the proper playing angle, even tiny variations of which can adversely affect the performance. The present invention also improves the aesthetic appearance of the piccolo by reducing the visible gap between headjoint and body which occurs with wooden piccolo metal-to-metal tenons.

Another significant component of the present invention is the inclusion of an F# mechanism, which separates the action of the two keys covering the B and B-flat toneholes. This allows the B-flat tonehole to be covered independently of the B tonehole, providing the optimum acoustic environment for the note "high-F#" to be sounded.

The thumb key mechanism disclosed in U.S. Pat. No. 5,708,226 granted to the inventor of the present invention, Nagahara on Jan. 13, 1998, allows for a single, enlarged C tonehole to be placed high enough on the body radius to eliminate the occurrence of water leakage through the C tonehole. Consequently, due to the elimination of the second C tonehole, there is now enough space between the C and trill toneholes to fit a C# trill mechanism, the benefits of which are described above.

The above mentioned Patent also allows for a connection between the B-flat thumb lever and the Bb key which more closely resembles the smooth, precise lever action found on the flute, the benefit of which is to ease the playing transition between flute and piccolo.

The above mentioned Patent also allows the addition of a new "G# mechanism" whereby the C tonehole is partially closed upon depression of the G# lever, affording the proper ventilation for the note "high-G#". The G# mechanism of the present invention more closely resembles that of the flute than previous piccolo G# mechanisms, which rely on the traditional piccolo thumb key assembly.

It is therefore an object of the present invention to provide an improved piccolo having a bore design consisting of an enlarged cylindrical section in the body, and an enlarged conical bore in the headjoint for better intonation and flexibility of tone and dynamics.

It is a further object of the present invention to provide a piccolo with enlarged toneholes for improved intonation and ventilation.

It is a further object of the present invention to provide a new key/pad design which eliminates overcrowding inherent in an 11.0 mm cylindrical bore instrument.

It is a further object of the present invention to provide an improved piccolo having an elongated body portion, or "footjoint" section to extend the range of the piccolo, adding the notes C# through B to the lower range of the instrument, simultaneously improving the acoustics of the extreme upper registers of the piccolo.

It is a further object of the present invention to provide an improved tenon for a maintenance-free airtight seal between the piccolo headjoint and body and as a result eliminate the need for the typical cork band at the headjoint and body interface.

It is a further object of the present invention to provide an improved tenon having a male headjoint portion outside the effective length of the headjoint.

It is a further object of the present invention to provide an improved tenon with graduated pitch-adjusting marks for ease of gauging the separation between body and headjoint.

It is a further object of the present invention to provide an improved tenon with graduated radial orientation marks for ease of gauging the blowhole alignment.

It is a further object of the present invention to provide an improved thumb key assembly for a piccolo that has improved lever action for closing the B tone hole indirectly via the B-flat shake key.

It is a further object of the present invention to provide an improved piccolo having a C# trill mechanism to be used in conjunction with the above mentioned thumb key design as described in U.S. Pat. No. 5,708,226.

It is a further object of the present invention to provide an improved piccolo having a G# mechanism to be used in conjunction with the above mentioned thumb key design as described in U.S. Pat. No. 5,708,226.

It is a further object of the present invention to provide an improved piccolo having an F# mechanism to close the B-flat tonehole independently of the B tonehole when sounding note "high-F#".

It is a further object of the present invention to provide a piccolo system incorporating all of the above-mentioned features for an overall superior piccolo instrument.

BRIEF DESCRIPTION OF THE DRAWINGS

FIGS. 4A–E is a cross-sectional view detailing the differences between the traditional cup/pad key design and the key/pad design of the present invention;

DETAILED DESCRIPTION OF THE PREFERRED EMBODIMENT

Figure 1:
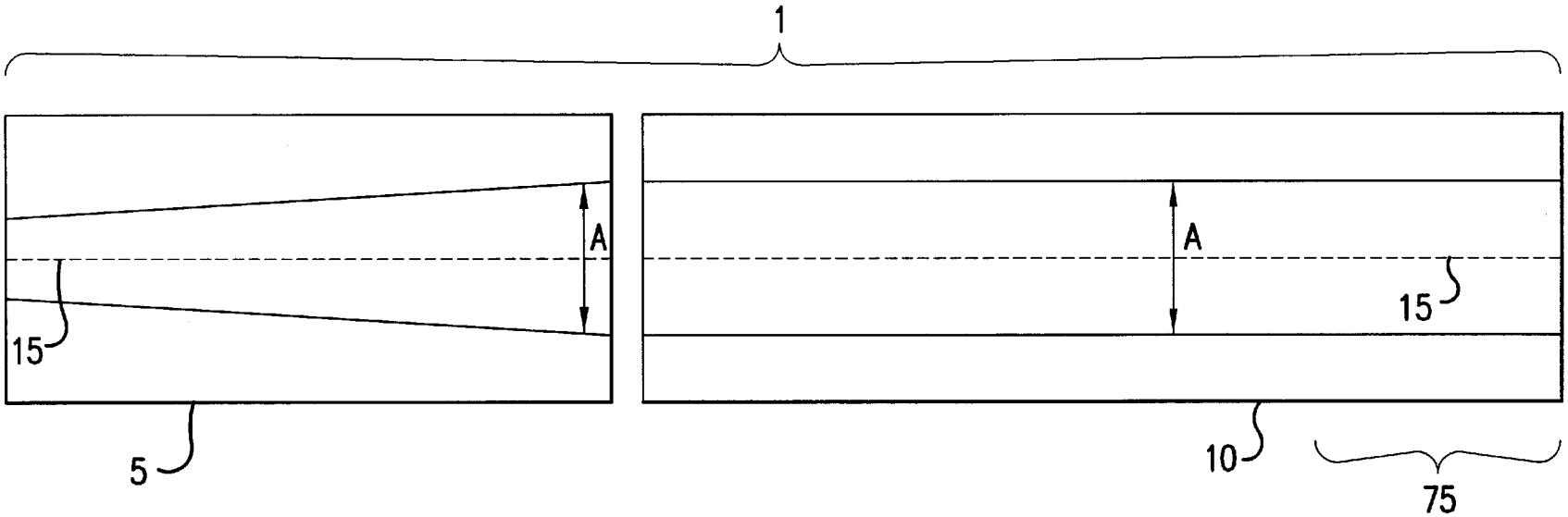
FIG. 1 is a plan view depicting the head joint conical bore and the body section cylindrical bore.

FIG. 1 depicts the preferred embodiment for a bore through a headjoint section 5 and a body section 10 of a piccolo 1 in accordance with the present invention. As clearly shown, the bore through the body section 10 of piccolo 1 is centered about the longitudinal axis 15 of piccolo 1 and extends throughout the entire length of body section 10. Furthermore, the bore through body section 10 of piccolo 1 is uniform in diameter (11.5 mm in the preferred embodiment) throughout its entire length. Headjoint 5 of the present invention has a bore therethrough that is varied in diameter. As shown in FIG. 1 the bore through headjoint 5 is centered about the longitudinal axis 15 of the piccolo 1 and extends throughout the entire length of the headjoint 5 section. In its preferred embodiment piccolo 1 has a cylindrical bore through body section 10 having a diameter of between 11.1 mm and 12.0 mm. However, this specific range of values is merely illustrative of the preferred embodiment and is not meant to be a limitation of the general invention disclosed herein. The conical bore through headjoint 5, at the end of the head joint 5 that interfaces with body section 10, has a diameter equal to the diameter of the cylindrical bore in body 10. The opposite end of the conical bore of headjoint 5 has a smaller diameter than the end directly interfacing with body 10, thereby allowing for the conical, tapered shape bore through headjoint 5.

Figure 2:
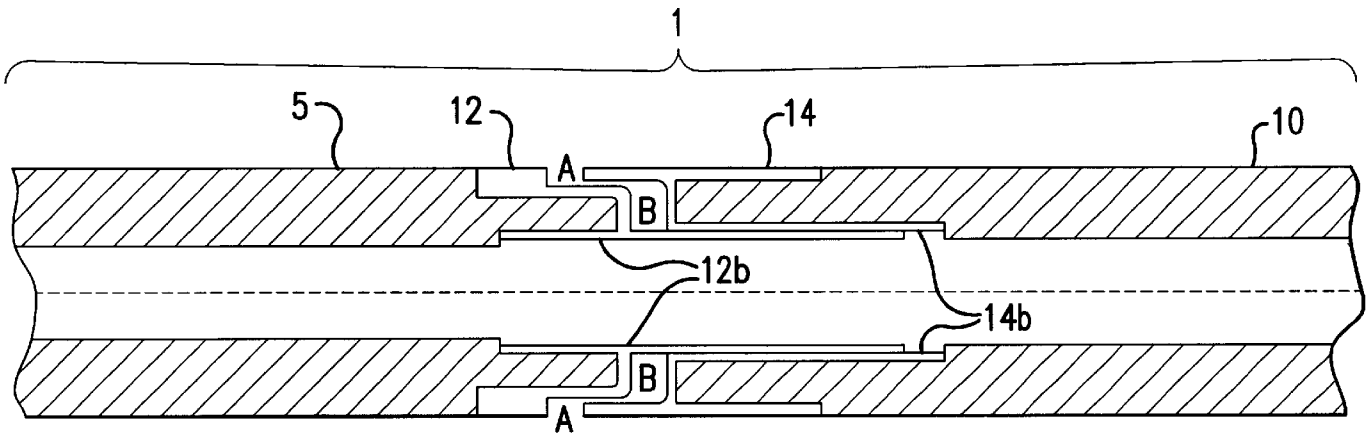
FIG. 2 is a cross-sectional view of the stepped interface tenon assembly between the head joint and the body section detailing the interfacing surfaces of each.

FIG. 2 is a cross-sectional view of a piccolo embodying a tenon section having a metal-to-metal interface in accordance with the present invention. FIG. 2 depicts the metal-to-metal stepped interface tenon section of the present invention between headjoint section 5 and body section 10 of piccolo 1 that replaces and eliminates the need for a seal or gasket constructed from cork, rubber or other materials. Since FIG. 2 is a cross-sectional view of piccolo 1, it is understood that the metal-to-metal interface depicted therein extends circumferentially around piccolo 1. The tenon section has a metal-to metal interface comprising a stepped headjoint section metal collar 12 and a stepped body section metal collar 14. The headjoint 5 and body 10 collars, 12 and 14 respectively, engage and form an air-tight seal at surface B. Surface 12*b* of headjoint metal collar 12 engages with and makes contact with surface 14*b* of body metal collar 14 at surface area B. The stepped configuration of metal collars 12 and 14 allows the player to vary the pitch produced by the piccolo by varying the separation distance between headjoint 5 and body section 10 which adjusts the overall length of piccolo 1.

Figure 3:
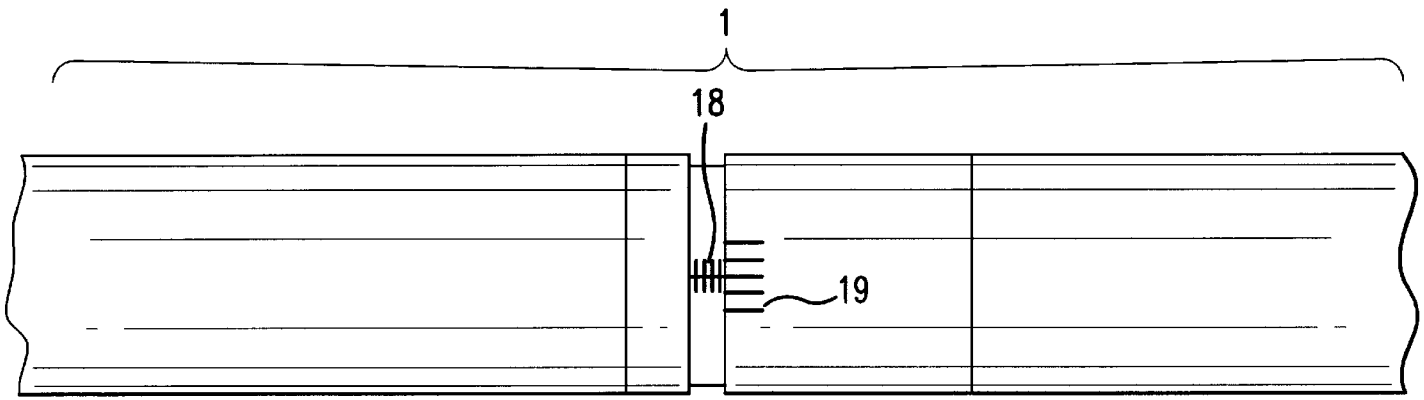
FIG. 3 is a plan view looking down on the pitch-adjusting marks and radial orientation markins located on the stepped interface tenon assembly.

Referring to FIG. 3, graduated pitch-adjusting marks 18 are disposed, at measured intervals, on the headjoint metal collar 12 at surface 12*a* so that the player can accurately control the fundamental pitch of piccolo 1 and thereby play in tune with other instruments of an ensemble. The pitch-adjusting marks 18 need not extend entirely around the circumference of the headjoint metal collar 12 so long as the player can visually reference and adjust the separation between headjoint 5 and body 10 of piccolo 1. The distance between the outer surface of piccolo 1 and surface area A is minimal, consisting of only the thickness of the metal comprising body collar 14. This has the benefit of maintaining the clean lines of the piccolo and the beauty of a fine, hand crafted piccolo.

Also depicted in FIG. 3 are radial orientation markings 19 disposed along the outside of body metal collar 14 which allow the piccolo player to quickly and repeatedly orient the blowhole of the piccolo to obtain the proper playing angle.

Figure 4A:
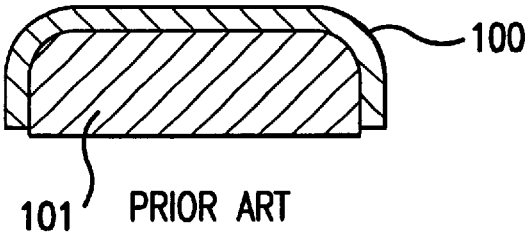
PRIOR ART FIG.4A

Referring to FIG. 4A, the traditional cup and pad assembly shows cup 100 extending downward into the plane of pad 101. The key/pad assembly of FIG. 4B of the present invention consists of a solid key 102, preferably of metal, having a center protrusion 103 acting as a centering and supporting device for pad 104. Pad 104 is attached to key 102 by means of screw 105 inserted through washer 106 and threaded into protrusion 103. The key/pad assembly of FIG. 4C of the present invention consists of a solid key 107 having a center protrusion 108 and a pad 109 attached to key 107 by an applied adhesive. The key/pad assembly of FIG. 4D consists of a solid key 110 having a center protrusion 111, which dovetails with pad 112 to hold pad 112 in place. FIG. 4E shows a key/pad assembly of the present invention having a solid key 113 having a central protrusion 114, around which is fixed O-ring 115. In the preferred embodiment, pads 104, 109, and 112 are fabricated from silicon rubber, but it is understood that any suitable material may be used.

Figure 5:
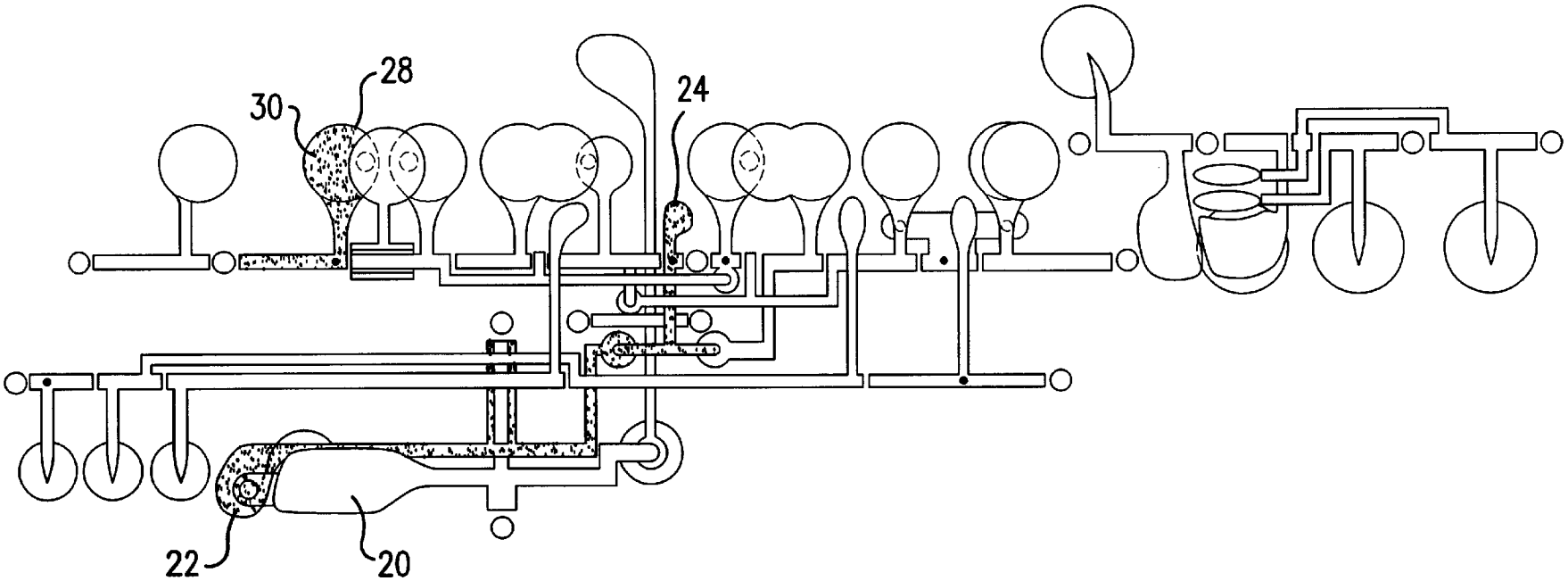
FIG. 5 is a plan view looking down on the piccolo of the present invention highlighting the relevant components of the improved thumb key mechanism.

FIG. 5 depicts the improved thumb key mechanism encompassing the present invention. The basic design for the thumb key mechanism depicted in FIG. 5 is disclosed in U.S. Pat. No. 5,708,226, granted to the inventor of the present invention Nagahara on Jan. 13, 1998. A critical difference has been developed which particularly applies to the present invention adapted to piccolos. This critically important feature of the thumb key mechanism design of the present invention is the manner in which the B-flat lever 22 closes the B tonehole 28. Here, the B tonehole 28 is not directly closed by activating the B-flat key 30 which covers B tonehole 28. Instead B tonehole 28 is closed when the thumb lever 22 is depressed actuating the B-flat shake key 24 which is rigidly linked thereto. This closes B-flat key 30 which is rigidly linked to the B-flat shake key 24. The effect of this method of closing the B tonehole 28 is better lever action. This improved lever action is the same as the action of flutes and thereby eases the transition a player must make when switching between flute and piccolo.

Figure 6:
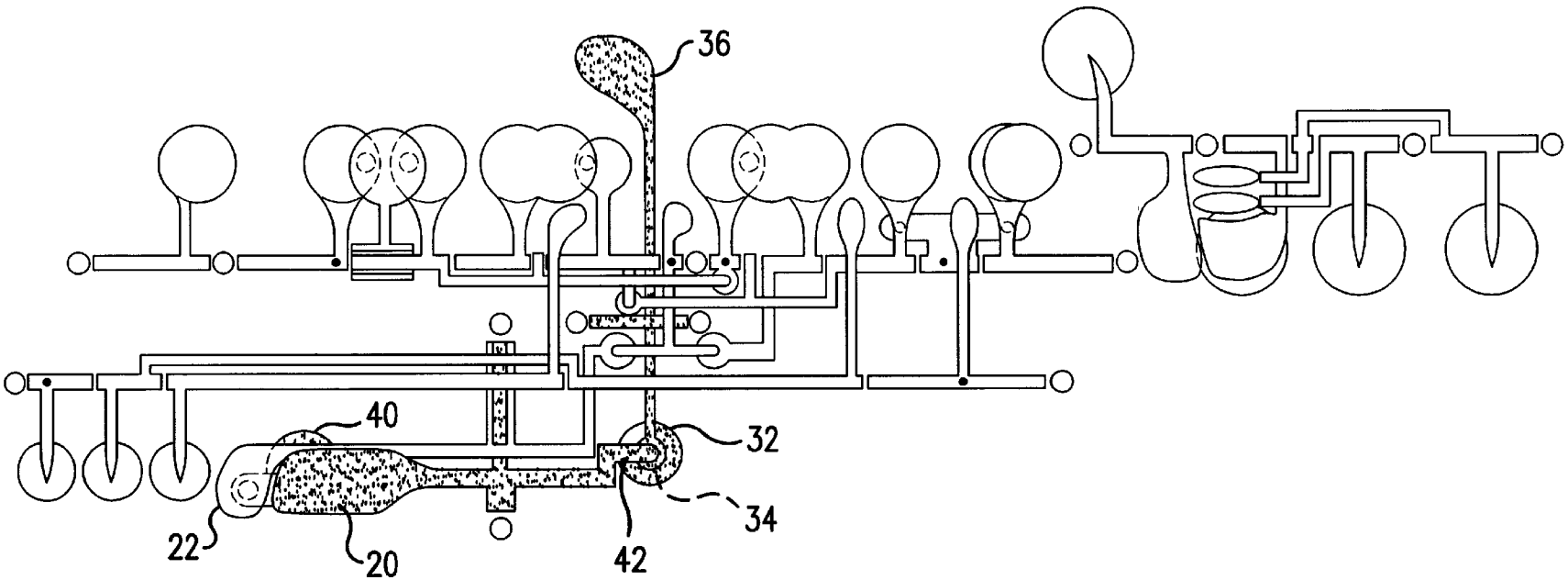
FIG. 6 is a plan view looking down on the piccolo of the present invention highlighting the relevant components of the improved G# mechanism.

In the present invention embodying the improved thumb mechanism disclosed it is possible to attain better tone from the high G# note. FIG. 6 depicts a G# mechanism designed to reduce the venting of tonehole 40 under thumb key 20 in order to achieve the best tone for the note "high G#". As clearly shown in FIG. 6, tail 42 of thumb key 20 rests atop G# cup 32, which in turn covers G# tonehole 34. When the G# lever 36 is depressed in order to play the note G#, the G# cup is raised, along with thumb key tail 42.

This causes thumb key 20 to partially close over tonehole 40, giving the proper ventilation required to obtain the best G# tone.

Figure 7:
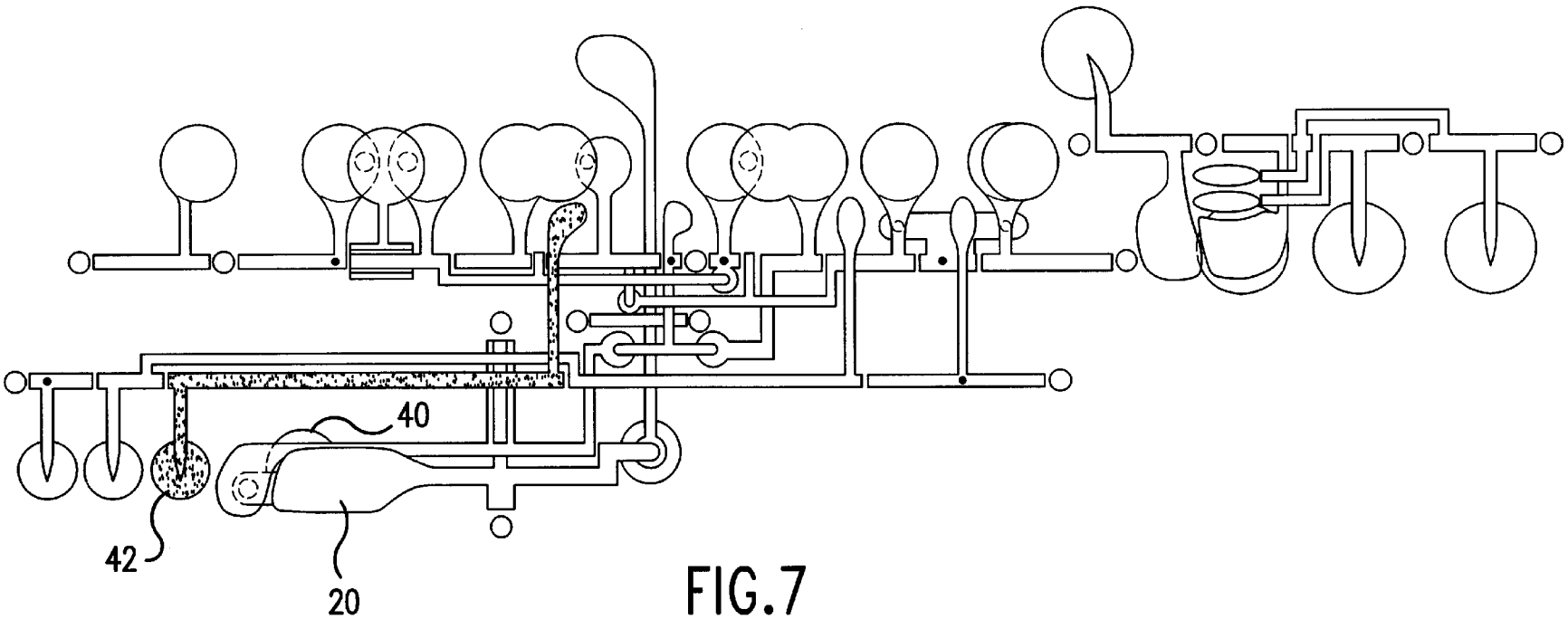
FIG. 7 is a plan view looking down on the piccolo of the present invention highlighting the relevant components of the improved C# trill mechanism.

The improved thumb mechanism of the present invention also facilitates the addition of a C# trill key 42 as depicted in FIG. 7. The addition of a C# trill key 42 has heretofore been impossible due to the conventional thumb key design of previous piccolos, as detailed above. The present invention, incorporating the above disclosed improved thumb key mechanism, allows for a single large C tonehole which, in turn, allows for the addition of the C# tonehole and C# mechanism 42.

Figure 8:
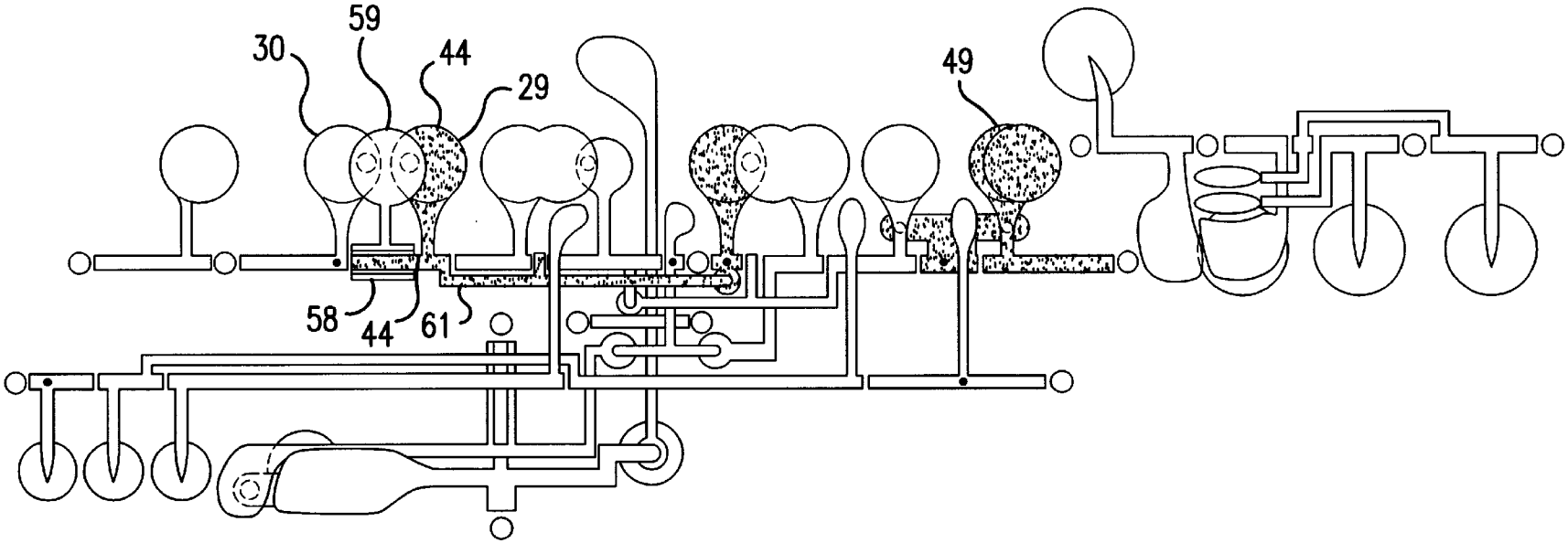
FIG. 8 is a plan view looking down on the piccolo of the present invention highlighting the relevant components of the improved F# mechanism.
Figure 9:
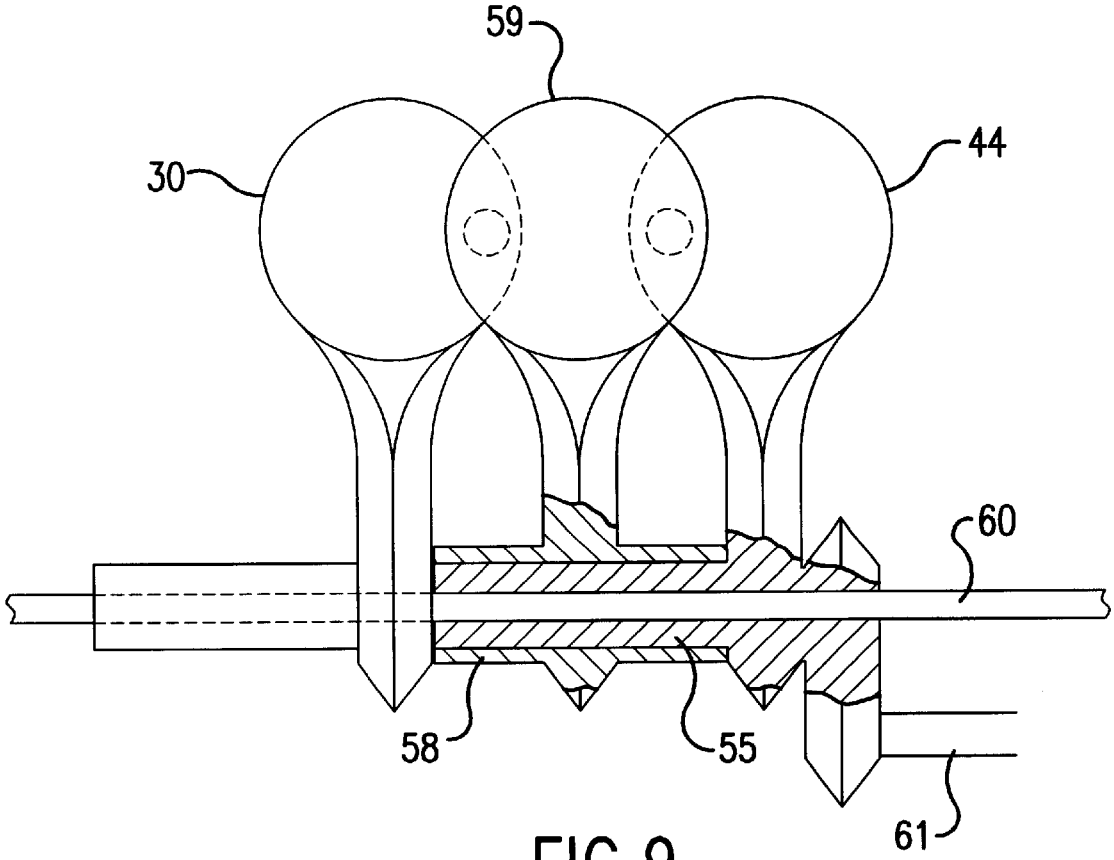
FIG. 9 is detailed cross-sectional view of the F# double-sleeve mechanism.
Figure 10:
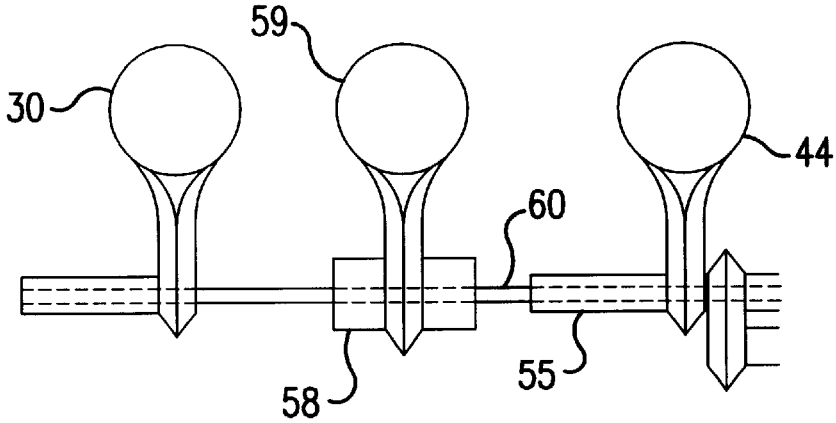
FIG. 10 is an exploded view of the F# double-sleeve mechanism.

In order to obtain the best tone for the note "high F#" it is desirable to close the B-flat tonehole 29 under A key 44 upon depression of the D key 49 as depicted in FIG. 8. The F# mechanism is nonexistent on piccolos due to size constraints, and, in fact, rare even on flutes due to the complexity of the mechanism itself. Depressing D key 49 of the present invention closes the A key 44 covering the B-flat tonehole 29, shown in FIG. 8 which allows the present piccolo to attain the optimum tone for the note "high F#". A unique aspect of the F# mechanism of the present invention is the double-sleeve configuration of the B-flat assembly, shown in FIG. 9, which links the action of the A key 44 and D key 49 via rod 61 and separates the action of A key 44 from B-flat key 30. FIG. 10 details the preferred embodiment, in which sleeve 55 rotates freely upon shaft 60, and in turn fits inside sleeve 58. This double-sleeve configuration separates the action of the A key 44 from B-flat key 30 and touch key 59, allowing the addition of the F# mechanism within the existing space limitations of the piccolo.

Figure 11:
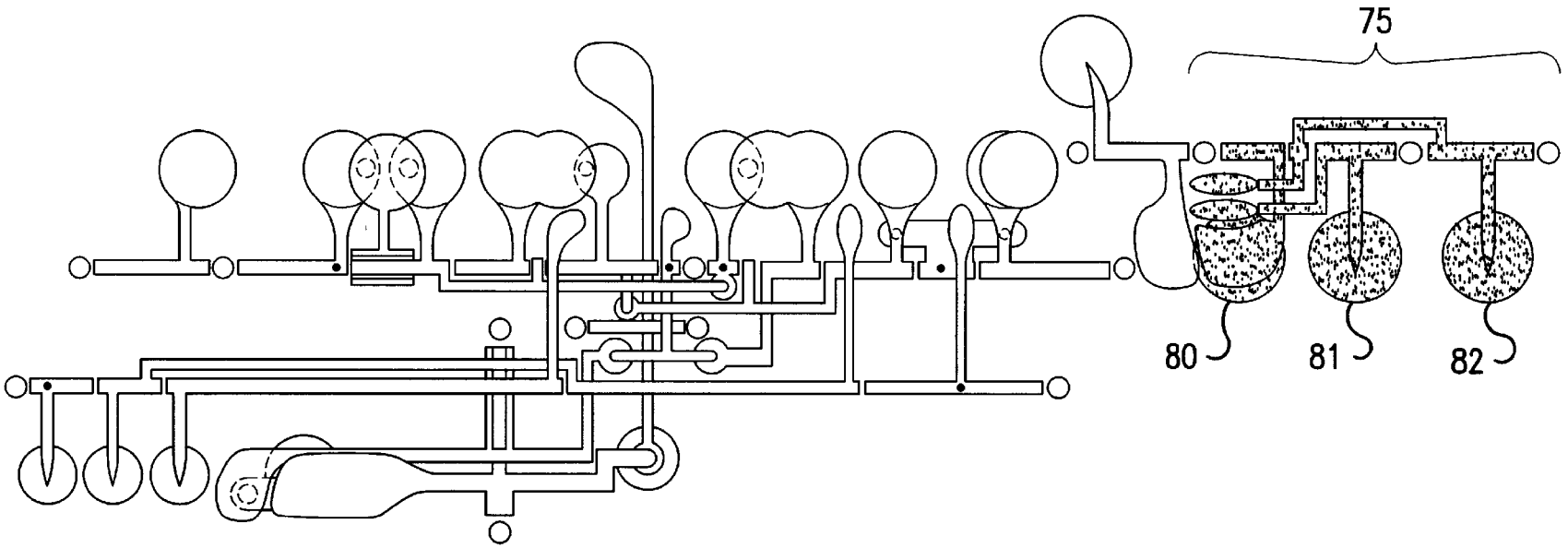
FIG. 11 is a plan view looking down on the piccolo of the present invention highlighting the footjoint section.

A piccolo "footjoint" section 75 is depicted in FIG. 11. Previous piccolo footjoint sections, due to their conical-bore construction, offered poor intonation and tone quality, and are consequently extremely rare. As mentioned above, previous cylindrical-bore piccolo footjoint designs suffered from poor ventilation due to the small 11.0 mm bore. The footjoint section 75 of the present invention, due to its enlarged cylindrical-bore construction and consequently larger maximum tonehole size, allows for the addition of the keys C# 80, C 81, and B 82, covering their respective toneholes, D 83, C# 84, and C 85, to attain the low notes C#, C and B with proper intonation and no loss in tone quality, along with the advantages of improved response and added notes in the extreme upper register of the piccolo.

Figure 12A:
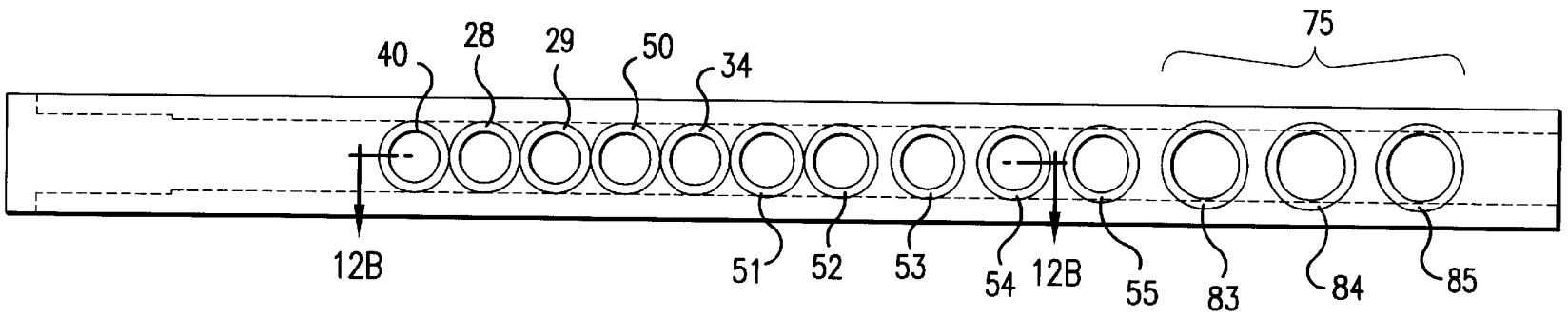
FIG. 12A is a top view of the body section of the improved piccolo of the present invention showing the enlarged toneholes. The toneholes are shown aligned along the same radial axis for illustrative purposes only.
Figure 12B:
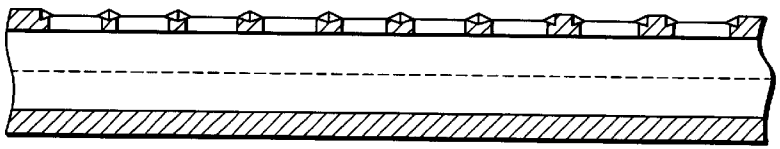
FIG. 12B is a side cutaway view of the body section of the improved piccolo of the present invention.

FIGS. 12A–12B depict the enlarged toneholes of the present invention. The toneholes of the left-hand section, numbered 40, 28, 29, 50, and 34 have diameters of not less than 7.5 mm. The toneholes of the right-hand section, numbers 51–54 have a diameter of not less than 8.6 mm. The toneholes of the footjoint section numbers 55 and 83–85 have diameters not less than 9.5 mm.

While the invention has been described and illustrated with reference to a specific embodiment thereof, it is understood that other embodiments may be resorted to without departing from the invention. It is also reiterated that the above-described preferred embodiment is also applicable to other instruments other than piccolos such as the flute. Therefore the form of the invention set out above should be considered illustrative and not as limiting the scope of the following claims.

What is claimed is:

1. An improved piccolo comprising:

a body section having a cylindrical bore therethrough wherein the cylindrical bore through said body section is centered about and coincident with a longitudinal axis of the piccolo and uniform in diameter throughout the entirety of said body section;

a headjoint having a conical bore therethrough wherein the conical bore through said headjoint is centered about and coincident with the longitudinal axis of the piccolo and varied in diameter from a diameter equal to the diameter of said body section's cylindrical bore at one end of said headjoint to a diameter less than the diameter of the cylindrical bore of said body section at other end of said headjoint whereby the longitudinal axis of said headjoint and the longitudinal axis of said body section are aligned and engaged such that the end of said headjoint having a conical bore diameter equal to the diameter of said body section cylindrical bore are matingly interfaced one to the other; and a metal-to-metal stepped interface tenon wherein said metal-to-metal stepped interface tenon comprises a stepped headjoint metal collar having an outer mating surface and an inner mating surface and a stepped body section metal collar having an outer mating surface and an inner mating surface wherein the headjoint metal collar and the body section metal collar slidingly engage, forming an airtight seal at the mating headjoint and body section inner mating surfaces.

2. The improved piccolo of claim 1 wherein the cylindrical bore through said body section has a predetermined fixed value between 11.1 mm to about 12.0 mm, inclusively.

3. The improved piccolo of claim 2 further comprising an extended footjoint section, said footjoint section comprising a D tonehole, a C# key, a C# tonehole, a C key, a C tonehole, and a B key, whereby the acoustics of the extreme upper register are enhanced, enabling a piccolo player to perform music written for the flute.

4. The improved piccolo of claim 3 further comprising left-hand toneholes of diameters greater than 7.5 mm, right-hand toneholes of diameters greater than 8.6 mm, and footjoint toneholes of diameters greater than 9.5 mm.

5. The improved piccolo of claim 1 further comprising an F# mechanism, said F# mechanism comprising an A key and a touch key slidingly engaged in stacked relation and pivotally mounted to the piccolo on a shaft in a double-sleeve configuration wherein the D key is rotationally linked to said A key such that depression of said D key rotates said A key thereby closing said B-flat tonehole.

6. The improved piccolo of claim 1 further comprising pitch-adjusting marks disposed at measured intervals on the outer mating surface of said headjoint metal collar whereby a piccolo player can visually gauge and adjust the separation between said headjoint and said body section for control of pitch.

7. The improved piccolo of claim 1 further comprising radial orientation markings along the outermost surface of said metal-to-metal tenon for alignment of the blowhole of said piccolo.

8. The improved piccolo of claim 1 having an improved thumb key mechanism, said improved thumb key mechanism comprising a thumb key, a thumb lever connected thereto further comprising a short length of tubing integrally connected in perpendicular relation to a longitudinal arm of said thumb lever, said thumb key and said thumb lever slidingly engaged in stacked relation and pivotally mounted to the piccolo on a shaft in a double-sleeve configuration wherein said thumb lever short length of tubing and said thumb key short length of tubing are interdisposed one inside of the other about said shaft, said improved piccolo further comprising a B-flat shake key couplingly linked to said thumb lever and rotationally linked to a B-flat key whereby depressing the thumb lever actuates the couplingly linked B-flat shake key which rotationally moves said B-flat key such that the B-flat key closes the B tonehole for the purpose of better thumb lever action.

9. The improved piccolo of claim 8 wherein said thumb key further comprises a tail portion coupled to a G# key such that depression of a G# lever pivots said G# key and said tail portion of said thumb key rotating said thumb key which partially closes the C tone hole for improved tone of the note high G#.

10. The improved piccolo of claim 8 further including a C# trill mechanism.

11. An improved piccolo or piccolo-type musical instrument having an improved thumb key mechanism, said improved thumb key mechanism comprising a thumb key having a short length of tubing integrally connected in perpendicular relation to a longitudinal arm of said thumb key; a thumb lever further comprising a short length of tubing integrally connected in perpendicular relation to a longitudinal arm of said thumb lever, said thumb key and said thumb lever slidingly engaged in stacked relation and pivotally mounted to the piccolo on a shaft in a double-sleeve configuration wherein said thumb lever short length of tubing and said thumb key short length of tubing are interdisposed one inside of the other about said shaft, the musical instrument further comprising a B-flat shake key couplingly linked to said improved thumb key mechanism thumb lever and rotationally linked to a B-flat key whereby depressing the thumb lever actuates the couplingly linked B-flat shake key which then rotationally moves the B-flat key such that the B-flat key closes the B tonehole for the purpose of better lever action.

12. The improved piccolo of claim 11 wherein said thumb key further comprises a tail portion coupled to a G# key such that depression of a G# lever pivots said G# key and said tail portion of said thumb key rotating said thumb key which partially closes the C tone hole for improved tone of the note high G#.

13. The improved piccolo of claim 11 further including a C# trill mechanism.

14. The improved piccolo of claim 11 further including a body section having a cylindrical bore therethrough wherein the cylindrical bore through said body section is centered about and coincident with a longitudinal axis of the piccolo and uniform in diameter throughout the entirety of said body section; and a headjoint having a conical bore therethrough wherein the conical bore through said headjoint is centered about and coincident with the longitudinal axis of the piccolo and varied in diameter from a diameter equal to the diameter of said body section's cylindrical bore at one end of said headjoint to a diameter less than the diameter of the cylindrical bore of said body section joint at other end of said headjoint whereby the longitudinal axis of said headjoint and the longitudinal axis of said body section are aligned and engaged such that the end of said headjoint having a conical bore diameter equal to the diameter of said body section cylindrical bore are matingly interfaced one to the other.

15. The improved piccolo of claim 14 wherein the cylindrical bore through said body section has a predetermined fixed value from about 11.1 mm to 12.0 mm.

16. The improved piccolo of claim 11 further comprising a metal-to-metal stepped interface tenon wherein said metal-to-metal stepped interface tenon comprises a stepped headjoint metal collar having an outer mating surface and an inner mating surface and a stepped body section metal collar having an outer mating surface and an inner mating surface whereby the headjoint metal collar and the body section metal collar slidingly engage, forming an airtight seal at the mating head joint and body section inner mating surfaces.

17. The improved piccolo of claim 16 further comprising pitch-adjusting marks disposed at measured intervals on the outer mating surface of said headjoint metal collar whereby a piccolo player can visually gauge and adjust the separation between said headjoint and said body section for control of pitch.

18. The improved piccolo of claim 16 further comprising radial orientation markings along the outermost surface of said metal-to-metal tenon whereby a piccolo player may visually align and orient the blowhole and obtain the proper playing angle.

19. The improved piccolo of claim 11 further comprising an extended footjoint section, said footjoint section comprising a D tonehole, a C# key, a C# tonehole, a C key, a C tonehole, and a B key, whereby the acoustics of the extreme upper register are enhanced, enabling a piccolo player to perform music written for the flute.

20. The improved piccolo of claim 19 further comprising left-hand toneholes of diameters greater than 7.5 mm, right-hand toneholes of diameters greater than 8.6 mm, and footjoint toneholes of diameters greater than 9.5 mm.

21. The improved piccolo of claim 11 further comprising an F# mechanism, said F# mechanism comprising an A key and a touch key slidingly engaged in stacked relation and pivotally mounted to the piccolo in a double-sleeve configuration wherein a D key is rotationally linked to said A key such that depression of said D key rotates said A key thereby closing said B-flat tonehole.

22. An improved wooden piccolo comprising:

a body section having a cylindrical bore therethrough wherein the cylindrical bore through said body section is centered about and coincident with a longitudinal axis of the piccolo and uniform in diameter throughout the entirety of said body section;

a headjoint having a conical bore therethrough wherein the conical bore through said headjoint is centered about and coincident with the longitudinal axis of the piccolo and varied in diameter from a diameter equal to the diameter of said body section's cylindrical bore at one end of said headjoint to a diameter less than the diameter of the cylindrical bore of said body section at other end of said headjoint whereby the longitudinal axis of said headjoint and the longitudinal axis of said body section are aligned and engaged such that the end of said headjoint having a conical bore diameter equal to the diameter of said body section cylindrical bore are matingly interfaced one to the other;

a metal-to-metal stepped interface tenon wherein said metal-to-metal stepped interface tenon comprises a stepped headjoint metal collar having an outer mating surface and an inner mating surface and a stepped body section metal collar having an outer mating surface and an inner mating surface wherein the headjoint metal collar and the body section metal collar slidingly engage, forming an airtight seal at the mating headjoint and body section inner mating surfaces; and wherein said piccolo is wooden.

23. The improved musical instrument of claim 22 wherein the cylindrical bore through said body section has a predetermined fixed value between 11.1 mm to about 12.0 mm, inclusively.

24. The improved musical instrument of claim 22 further comprising an F# mechanism, said F# mechanism comprising an A key and a touch key slidingly engaged in stacked relation and pivotally mounted to the piccolo in a double-sleeve configuration wherein a D key is rotationally linked to said A key such that depression of said D key rotates said A key thereby closing said B-flat tonehole.

25. The improved musical instrument of claim 23 further comprising an extended footjoint section, said footjoint section comprising a D tone hole, a C# key, a C# tone hole, a C key, a C tone hole, and a B key, whereby the acoustics of the extreme upper register are enhanced, enabling a piccolo player to perform music written for the flute.

26. The improved musical instrument of claim 25 further comprising left-hand toneholes of diameters greater than 7.5 mm, right-hand toneholes of diameters greater than 8.6 mm, and footjoint toneholes of diameters greater than 9.5 mm.

27. The improved musical instrument of claim 22 further comprising pitch-adjusting marks disposed at measured intervals on the outer mating surface of said headjoint metal collar whereby a piccolo player can visually gauge and adjust the separation between said headjoint and said body section for control of pitch.

28. The improved musical instrument of claim 22 further comprising radial orientation markings along the outermost surface of said metal-to-metal tenon for alignment of the blowhole of said musical instrument.

29. The improved musical instrument of claim 22 having an improved thumb key mechanism, said improved thumb key mechanism comprising a thumb key having a short length of tubing integrally connected in perpendicular relation to a longitudinal arm of said thumb key; a thumb lever further comprising a short length of tubing integrally connected in perpendicular relation to a longitudinal arm of said thumb lever, said thumb key and said thumb lever slidingly engaged in stacked relation and pivotally mounted to the piccolo on a shaft in a double-sleeve configuration wherein said thumb lever short length of tubing and said thumb key short length of tubing are interdisposed one inside of the other about said shaft, said improved musical instrument further comprising a B-flat shake key couplingly linked to said thumb lever and rotationally linked to the B key whereby depressing the thumb lever actuates the couplingly linked B-flat shake key which then rotationally moves a B-flat key such that the B-flat key closes the B tonehole for the purpose of better thumb lever action.

30. The improved musical instrument of claim 29 wherein said thumb key further comprises a tail portion coupled to a G# key such that depression of a G# lever pivots said G# key and said tail portion of said thumb key rotating said thumb key which partially closes the C tone hole for improved tone of the note high G#.

31. The improved musical instrument of claim 29 further including a C# trill key mechanism.

* * * * *